US006324861B1

(12) United States Patent
Jeuch

(10) Patent No.: US 6,324,861 B1
(45) Date of Patent: Dec. 4, 2001

(54) SELF-COOLING PACKAGE FOR BEVERAGE

(75) Inventor: Pierre Jeuch, Saint Aubin (FR)

(73) Assignee: Thermagen (S.A.), Poissy (FR)

( * ) Notice: Subject to any disclaimer, the term of this patent is extended or adjusted under 35 U.S.C. 154(b) by 0 days.

(21) Appl. No.: 09/645,823

(22) Filed: Aug. 24, 2000

(30) Foreign Application Priority Data

Jun. 13, 2000 (FR) ..... 0007531

(51) Int. Cl.[7] ..... F25D 3/10
(52) U.S. Cl. ..... 62/294; 62/451
(58) Field of Search ..... 62/294, 451

(56) References Cited

U.S. PATENT DOCUMENTS 4,126,016 11/1978 Greiner .
4,319,464 * 3/1982 Dodd ..... 62/294
4,736,599 * 4/1988 Siegel ..... 62/294

FOREIGN PATENT DOCUMENTS 97 04531 10/1998 (FR) .

* cited by examiner

*Primary Examiner*—William Doerrler
*Assistant Examiner*—Mohammad M. Ali
(74) *Attorney, Agent, or Firm*—Sughrue, Mion, Zinn Macpeak & Seas, PLLC

(57) ABSTRACT

A self-cooling package for beverages that includes a cooling device internal to the package and connection to a pumping device external to the package. The internal cooling device is by a cavity filled with a coolant that evaporates under the effect of a depression.

27 Claims, 5 Drawing Sheets

Coupe AA

CoupeBB

CoupeCC

Coupe AA

Coupe BB

SELF-COOLING PACKAGE FOR BEVERAGE

BACKGROUND OF THE INVENTION

1. Field of the Invention

The present invention relates to a beverage package used to cool its contents. The invention can be applied especially to the cooling of beverages contained in a can or bottle type closed package.

It is an object of the present invention to enable the consumption of a beverage at ideal temperature at all times and in all places.

There are mainly two physical methods for cooling the contents of a package or container. Firstly, there is cooling by the expansion of a gas according to the classic laws of thermodynamics which link temperature to pressure and, secondly, cooling by evaporation and adsorption, the principle of which lies in evaporating a liquid under the effect of depression sustained by adsorption of the vapors of said liquid.

2. Description of the Prior Art

Thus, for example the first method has been implemented in the French patent application No. FR 97 04531 which proposes the cooling of a canned beverage by means of an expansion of compressed gas. A cartridge of gas to be expanded is placed in a metal heat sink that is itself placed inside the can.

This approach has several drawbacks. Firstly, the gas cartridge takes up about half the volume of the beverage to be cooled. This is dictated by the quantity of gas needed to cool the beverage. Furthermore, the cost of a cartridge of compressed gas is high. This leads to a very sharp increase in the price of the can.

Much research has also been devoted in the prior art to the other method of cooling by evaporation and adsorption. Many devices have been proposed, associating an evaporator device, containing a liquid to be evaporated, with a container containing an adsorbent.

Thus, for example, a method of this kind has been implemented in autonomous devices such as portable refrigerators. The U.S. Pat. No. 4,126,016, of which an illustration is given in FIG. 1, proposes a disposable two-part cooling system. An evaporating container 107, consisting of a chamber containing the liquid to be evaporated, is within an enclosure 100 and another chamber containing the adsorbent 108 is outside, the two elements 107 and 108 being connected by a bayonet-type connection device 109.

This connection device 109 is however complicated to make, especially when a good vacuum is needed (the difficulty being related to the existence of moving parts in rotation and translation with a rubber seal). A device of this kind is not economical.

The application of the method of cooling by evaporation and adsorption has also been proposed for beverage packages.

Thus, the U.S. Pat. No. 4,736,599, of which an illustration is given in FIG. 2, proposes to make a heat exchanger 16 (evaporator device) totally contained within the container 10 to be cooled (explicitly described as a can). At the same time, this patent stresses the reversibility or two-way character of the intercommunication between the heat exchanger 16 and the adsorbent contained in a container 22 located beneath the can 10. This device has at least four valves: two to create the vacuum 19 and then fill 20 the exchanger 16, one to create the vacuum in the container 22 of the adsorbent and one to activate the cooling 27. A structure gives rigidity to the vacuum-tight chambers 16 and 22, and a tube 26 connects the different elements together. This complex construction certainly does not make for a cost price compatible with a disposable package such as a can, and the reversibility of the intercommunication contributes to this complexity.

Other patents, the U.S. Pat. No. 4,759,191, supplemented by the U.S. Pat. No. 5,048,301 by the same inventors, illustrated in FIG. 3, propose the cooling of a beverage 15 contained in a package 10 by means of a module 11 placed in the package 10 (presented as a can).

This module 11 consists of several chambers. A first chamber 12 contains the liquid (18) to be evaporated (water) and a second chamber 14, internal to the first chamber 12, contains desiccant 25 and "heat sink" 24. Activation means, which bring the water 18 and the desiccants 25 into communication, act as a pump for the water vapor. This reaction of adsorption which cools the first chamber 12 nevertheless causes a substantial release of heat in the second chamber 14. This heat may be trapped by particular materials 24 (by phase change or endothermal reaction). The second U.S. Pat. No. 5,048,301, in this respect, proposes to add a heat insulation feature (of the DEWAR type) by means of a vacuum chamber 13 surrounding the chamber 14 that contains the adsorbent 25.

None of the prior art inventions has seen any significant commercial application to date. This is because of technical reasons of performance and economic reasons of manufacturing cost. The present invention proposes solutions to these problems.

Indeed, certain technical and physical imperatives have never been seriously taken into account in the prior art, and the constraints of manufacturing costs are high, given the fact that the application concerns disposable devices.

The complexity of the devices proposed in the prior art is an evident obstacle to their development. The two-way intercommunication valves of the U.S. Pat. No. 4,736, 599, although not described in detail, are complex and expensive to manufacture. The U.S. Pat. No. 4,759,191 and the U.S. Pat. No. 5,048,301 suffer from the same economic constraints and also underscore the difficulty of removing the heat released in the package by the adsorbent, and the complex means that have to be used for this purpose.

Moreover, these devices cannot be used for to cool beverages rapidly. Indeed, two points essential to this kind of rapid cooling have not been sufficiently taken into account. The first point is the effectiveness of the heat exchange between the evaporator and the beverage, and the second point is the speed with which the vapors of the refrigerant liquid are pumped into the evaporator.

The pumping speed depends of course on the effectiveness on the adsorbent, and also on the geometrical characteristics of the means for making the evaporator communicate with the container of the adsorbent, and on the residual pressure of the non-adsorbable gases, namely gases other than the vapor of the refrigerant liquid.

Now, none of the prior art devices proposes any special arrangements to give an efficient vapor pumping rate. The different configurations proposed and the types of connection valves used suggest difficulties related to the geometry. But even more than these geometrical characteristics, it is the residual pressure of the non-adsorbable, and hence non-pumped, gases that limits the process.

The goal of the present invention is to overcome the drawbacks of the prior art.

The present invention proposes a self-cooling package for beverages whose working is based on the principle of the evaporation of a refrigerant liquid at reduced pressure.

To this end, the invention proposes a self-cooling package for beverages formed by two distinct elements.

The beverage package according to the invention contains cooling means consisting of an internal evaporator (a cavity) and means to connect these cooling means to pumping means external to the package. These pumping means cause and sustain the evaporation of a refrigerant liquid in the internal evaporator.

The internal cooling means and the external pumping means form the two distinct elements of the device according to the invention. They are connected by connection means but are independent in their design and manufacture.

SUMMARY OF THE INVENTION

An object of the present invention more particularly is a self-cooling package for beverages, comprising cooling means internal to said package and means of connection to pumping means external to said package, the internal cooling means being constituted by a cavity containing a refrigerant liquid that evaporates under the effect of a depression.

According to one characteristic, the ratio of the volume to the surface area of the internal cavity is three to seven times smaller than the ratio of the volume to the surface area of the package.

According to one characteristic, the internal cavity has a volume smaller than or equal to 2 cl for a package with a volume of 33 cl.

According to another characteristic, the internal cavity has a contact surface greater than or equal to 50 $cm^2$ for a package with a volume of 33 cl.

According to one particular feature of the invention, the internal cavity is sealed to the walls of the package.

According to one mode of implementation, the refrigerant liquid is water.

According to another mode of implementation, the refrigerant liquid is water containing an additive that lowers its temperature of solidification.

According to one characteristic, the refrigerant liquid partially fills the internal cavity.

According to one characteristic, the partial pressure, in the internal cavity, of gases other than the vapor of the refrigerant liquid, before connection to the external pumping means, is lower than or equal to 3 mb.

According to one characteristic, the internal walls of the cavity are partially covered with a hydrophilic porous material.

According to one characteristic, the connection means comprise a cone-like structure closing the internal cavity and comprising a delidding punch zone, the external pumping means being provided with delidding means that get encased in said cone-like structure.

According to one characteristic, the internal cavity has a geometry such that the refrigerant liquid cannot flow through the connection means whatever the position in which the package is held.

According to a first embodiment, the cavity is a tubular structure made up of ribs mutually held together by plates and connected to the means of connection.

According to one particular feature, the cavity comprises a tube connecting the ribs to the connection means, said tube and the bottom of the package having crimped complementary conical shapes.

According to an alternative mode of implementation, the tube emerges at the center of the internal cavity, the ribs converging towards this central point.

According to a second embodiment, the internal cavity constitutes a double bottom of the package.

According to one particular feature, the internal cavity has a conical shape with a star section.

According to an alternative mode of implementation, the internal cavity comprises a helical structure.

According to an alternative mode of implementation, the cone-like structure of the connection means enclosing the cavity penetrates the interior of said cavity so that the delidding punch zone is located towards the center of gravity of the cavity.

According to a first application, the package is a steel can.

According to a second application, the package is an aluminium can.

According to one characteristic, the internal cavity is made of the same material as the pack.

According to another application, the package is a bottle made of resistant plastic (PET plastic).

According to another application, the package is a glass bottle.

According to a first mode of implementation, the self-cooling package according to the invention is connected to external pumping means constituted by an evacuated cartridge containing a material capable of adsorbing the refrigerant liquid.

According to a second mode of implementation, the self-cooling package is connected to external pumping means consisting of a mechanical vacuum pump.

According to a third mode of implementation, the self-cooling package is connected to external pumping means consisting of cryogenic pumping means.

The package according to the invention has performance characteristics and a flexibility far higher than those proposed in the prior art.

Moreover, it can be manufactured at very low cost, without dictating any major modification in the production lines of traditional package systems.

The designing of two distinct elements optimizes the industrial-scale production of the device according to the invention. The internal cavity must be added to the container, but it occupies a negligible volume and can advantageously be made of the same material. The shape of the cavity is furthermore designed to permit maximum heat exchange for a minimum occupied volume.

The external pumping means are developed and manufactured separately. Moreover, different pumping means can be considered depending on the application.

BRIEF DESCRIPTION OF THE DRAWINGS

Various characteristics and advantages of the present invention shall appear in the following description given as an non-restrictive illustration, made with reference to the appended drawings of which.

MORE DETAILED DESCRIPTION

Figure 1:
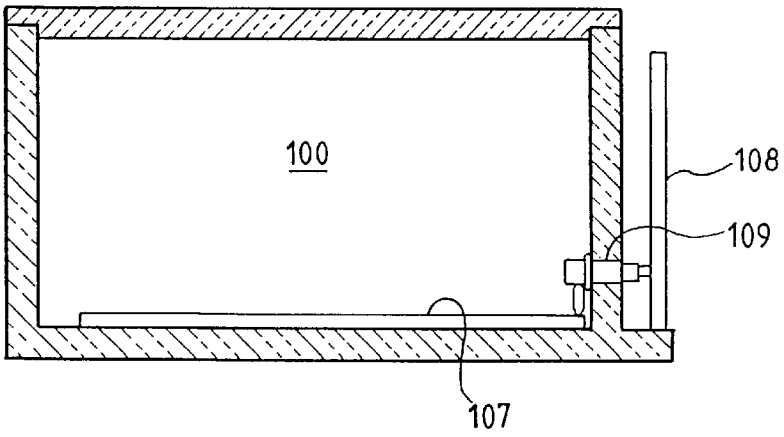
FIG 1 PRIOR ART
FIG. 1, already described, is a drawing of a prior art self-cooling portable device, FIG. 2, already described, is a drawing of a self-cooling can of beverage according to an alternative of the prior art.
Figure 2:
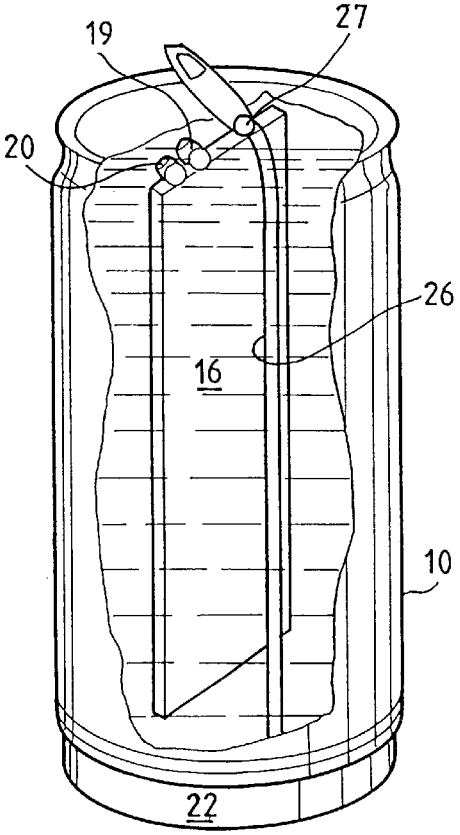
FIG 2 PRIOR ART
Figure 3:
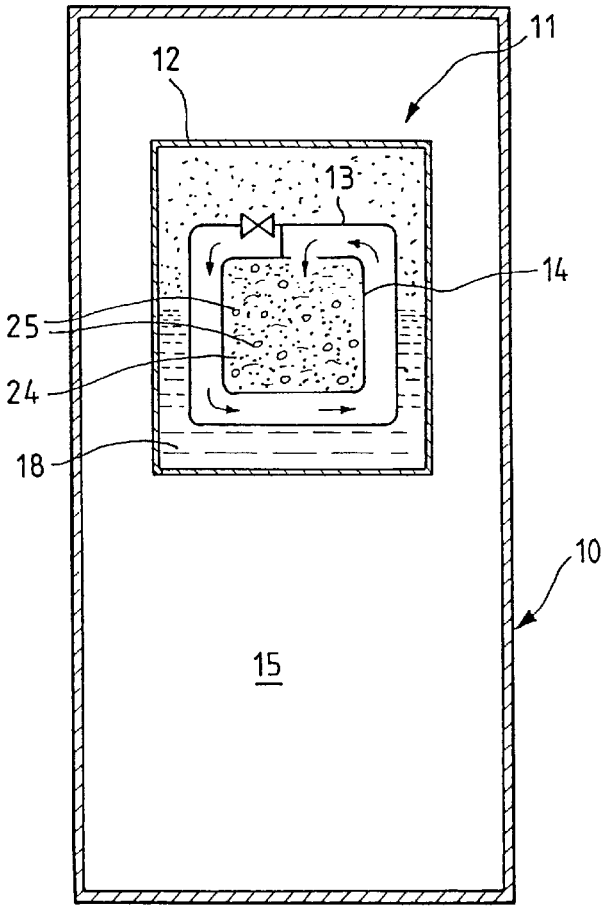
FIG 3 PRIOR ART
FIG. 3, already described, is a drawing of a self-cooling can of beverage according to another alternative of the prior art.
Figure 4:
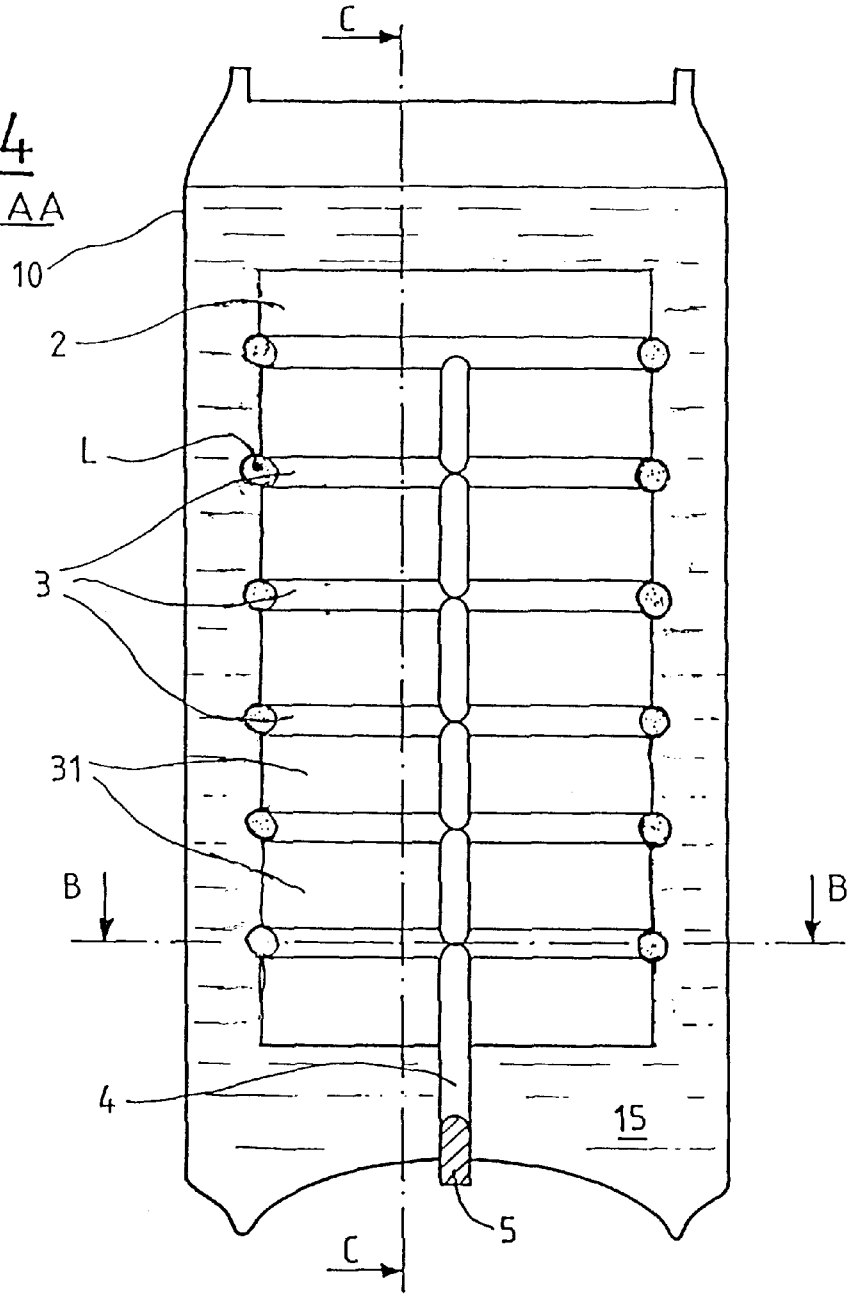
FIG. 4 is a diagrammatic cross-section view along AA of a beverage package according to a first embodiment of the invention.

The following description relates to a beverage package of the can type, made of steel or aluminium depending on the manufacturers and provided with cooling means based on the principle of the evaporation of a refrigerant liquid at reduced pressure. The invention may pertain, however, in the same way, to a beverage package of the glass bottle or resistant plastic (for example PET plastic) type.

A first embodiment shall be described with reference on FIGS. 4 to 7.

A beverage package, consisting of a can 10 with a standardized shape and volume, comprises a heat exchanger constituted by an interval cavity 2 containing a liquid L.

This cavity 2 has specific geometrical characteristics such that the ratio of its volume to its surface area is three to seven times smaller than the volume-to-surface ratio of the package 10. Thus, for example, for a can 10 with a standard volume of 33 cl, the volume of the cavity 2 is smaller than or equal to 2 cl and its contact surface area is greater than or equal to 50 $cm^2$.

In order to facilitate its manufacture and recycling, the cavity 2 is advantageously made of the same material as the can 10, namely steel or aluminium. For a bottle type package, the cavity 2 will preferably be made of a thermally conductive material such as aluminium for example.

The refrigerant liquid L contained in the internal cavity 2 may be water, or preferably water containing an additive that lowers its temperature of solidification, such as NaCl for example. With such an additive, it is possible to increase the beverage cooling speed by lowering the temperature of the cavity 2 (the heat exchanger) to below 0° C. when the refrigerant liquid L is water.

According to an advantageous characteristic, the liquid L only partially fills the cavity 2, for example half of it.

According to another particular characteristic of the invention, the internal walls of the cavity 2 are advantageously covered with a hydrophilic, porous material like cellulose or a polymer for example.

According to one particular characteristic of the invention, the self-cooling beverage package does not comprise any filling or pumping valve. The cavity 2, containing the liquid L to be evaporated under vacuum, is sealed to the package 10 by the cold crimping of two cones into each other or by bonding or any other technique.

According to another characteristic of the invention, the internal cavity 2 contains only the refrigerant liquid L as well as the vapors of said liquid L. In other words, the liquid L has been degassed prior to being introduced into the cavity 2. This degassing can be obtained, in particular, by boiling at atmospheric pressure followed by boiling with reduction of pressure to a few millibars.

In other words, the partial pressure, in the internal cavity 2, of the gases other than the vapor of the refrigerant liquid L, before the cavity 2 is connected to the external pumping means, is lower than or equal to 3 mb. This characteristic gives good speed of evaporation and at the same time prevents the evaporation reaction from being limited by any non-adsorbable gases that might be contained in the cavity 2.

The geometry of the cavity 2 is important in relation to the cooling speed to be obtained because it conditions the effectiveness of the heat exchange between the cavity 2 and beverage to be cooled.

According to the first embodiment, referring to FIGS. 4 to 7, the geometry of the cavity 2 favors a large heat-exchange surface area with the beverage to be cooled for a low volume occupied in the package 10. The ratio of the volume to the surface area of the cavity 2 is then 5 to 7 times the corresponding ratio in the package 10 of beverage.

According to this embodiment, the cavity 2 is a tubular structure, mainly made up of pumping tubes 3, which form ribs held together by plates 31. The ribs 3 have a ¾ cylinder shape and end in a common tube 4. They contain the refrigerant liquid L to be evaporated.

The internal cavity 2 may advantageously have the shape of an arc of a circle matching the shape of the can 10. It is attached to the walls of the can 10 by fastening means 6 consisting of clamps that are welded or bonded for example.

Figure 7:
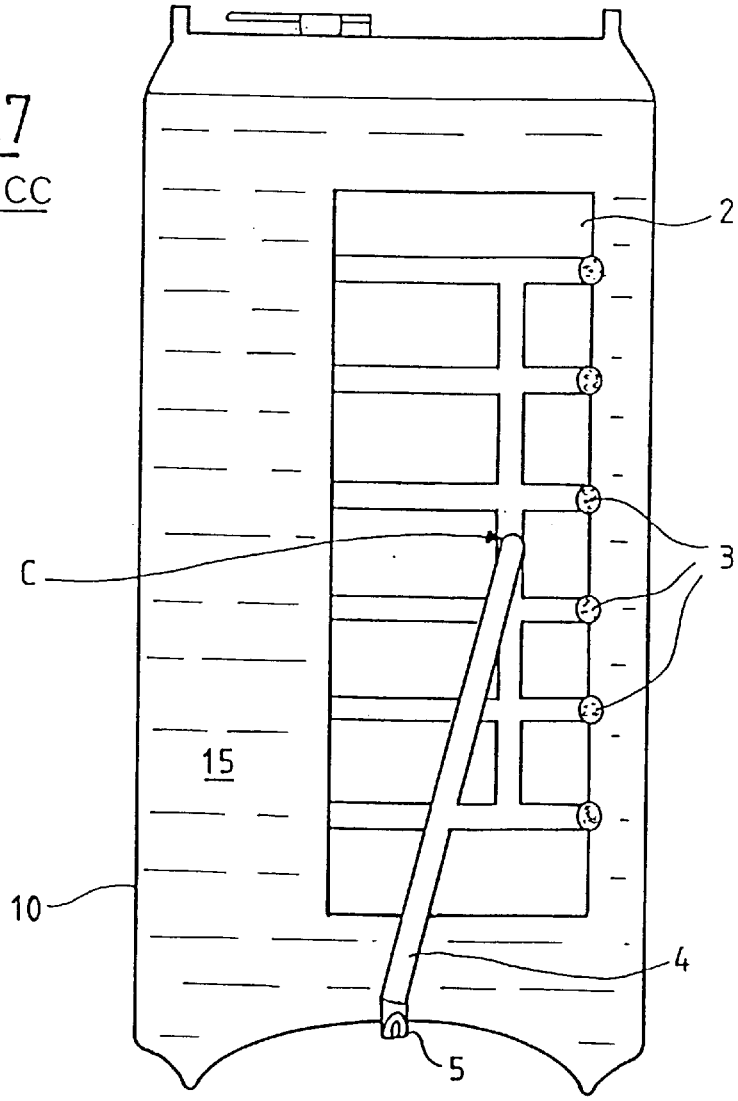
FIG. 7 is a diagrammatic cross-section view along CC of an alternative embodiment of the first mode according to the invention.

FIG. 7 illustrates an alternative embodiment in which the common tube 4 emerges in the center C of the cavity 2. This arrangement prevents the flow of the refrigerant liquid L through the connection means 5 and thus procures the evaporation reaction, whatever the position in which the can 10 is held during its connection to the external pumping means.

Figure 5A:
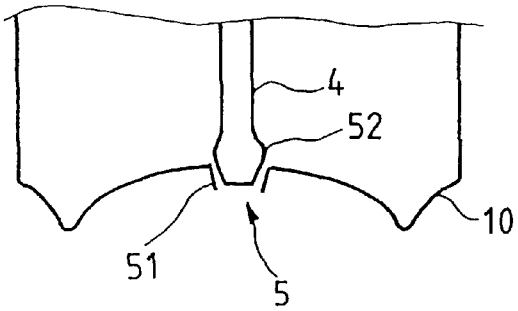
FIGS. 5*a* and 5*b* are detailed views of the connection means of FIG. 4.
Figure 5B:
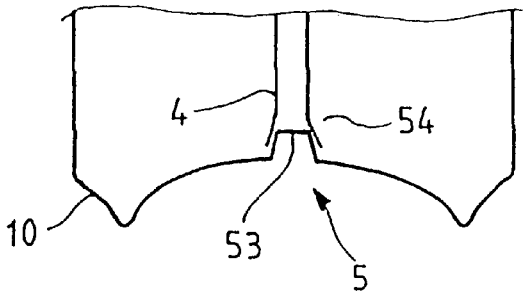
Figure 6:
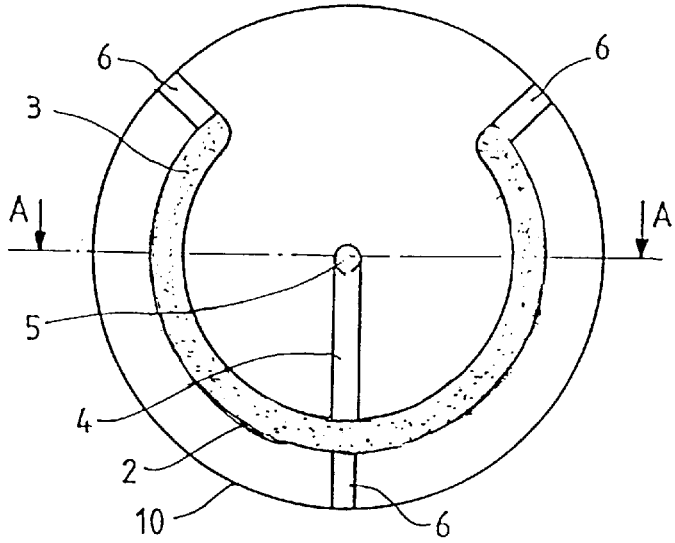
FIG. 6 is a diagrammatic top view along BB of FIG. 4.

The means of connection 5, which connect the tube 4 of the internal cavity 2 with the external pumping means, are illustrated in detail in FIGS. 5*a* and 5*b*.

These connection means 5 associate the tube 4 and the bottom of the package 10 by crimped, complementary conical shapes.

Thus, for example, in the configuration of FIG. 5*a,* the tube 4 has a tip 52 in the shape of a cone set in an inverted hump 51 of the bottom of the package 10. It is the tube 4 of the cavity 2 that closes the bottom of the package 10 when it is assembled. The cavity 2 is sealed under vacuum before being fixed at the bottom of the package 10.

Conversely, in the configuration of FIG. 5*b,* the tube 4 has a tip 54 with an inverted hump set on a cone 53 of the bottom of the package 10. In this configuration, it is the cone 53 of the bottom of the package 10 that closes the cavity 2 when it is assembled. To ensure a good vacuum in the cavity 2, this assembly can be done in air-free conditions under pressure of saturating vapor from the refrigerant liquid L.

These two configurations are given by way of illustrative examples, but it is possible to consider other combinations relating to the direction of the hump features and the nature of the closing of the cavity and of the bottom of the package.

In particular, the cavity 2 can be closed by means of a conical stopper 55 (FIG. 8) for example, positioned after the cavity 2 has been joined to the package 10. This stopper may, if necessary, form part of the external pumping means if these means are assembled jointly with the package during its manufacture.

Moreover, it may be planned to connect the tube 4 of the cavity 2 to the lid of the package 10 rather than to its bottom.

In all the configurations, the structure that closes the cavity 2 must necessarily comprise a delidding punch zone, i.e. a thinning of the structure, to allow an opening to be cut out in the internal cavity 2 using delidding means associated with the external pumping means.

The delidding means may have different forms, tubular or pointed for example, and may be activated by different means, manual pressure for example. Their function is to press on the delidding recess to cut out an opening in the internal cavity 2 and to thus activate the reaction of evaporation and the implementation of the process of cooling the beverage contained in the package 10.

Figure 8:
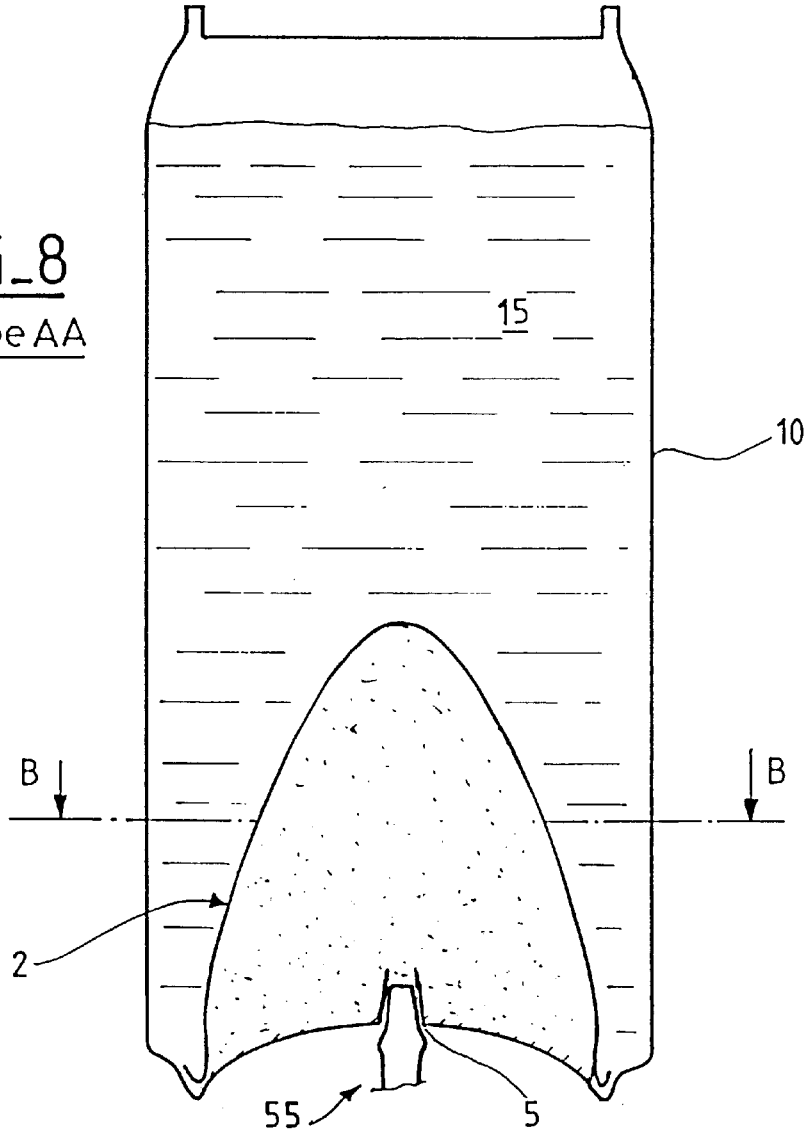
FIG. 8 is a diagrammatic cross-section view of a beverage package according to a second embodiment of the invention.
Figure 9:
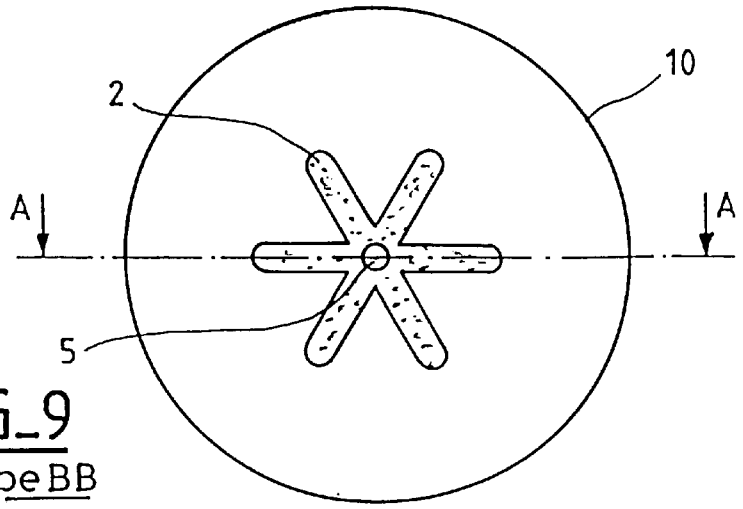
FIG. 9 is a diagrammatic top view along BB of FIG. 8.
Figure 10:
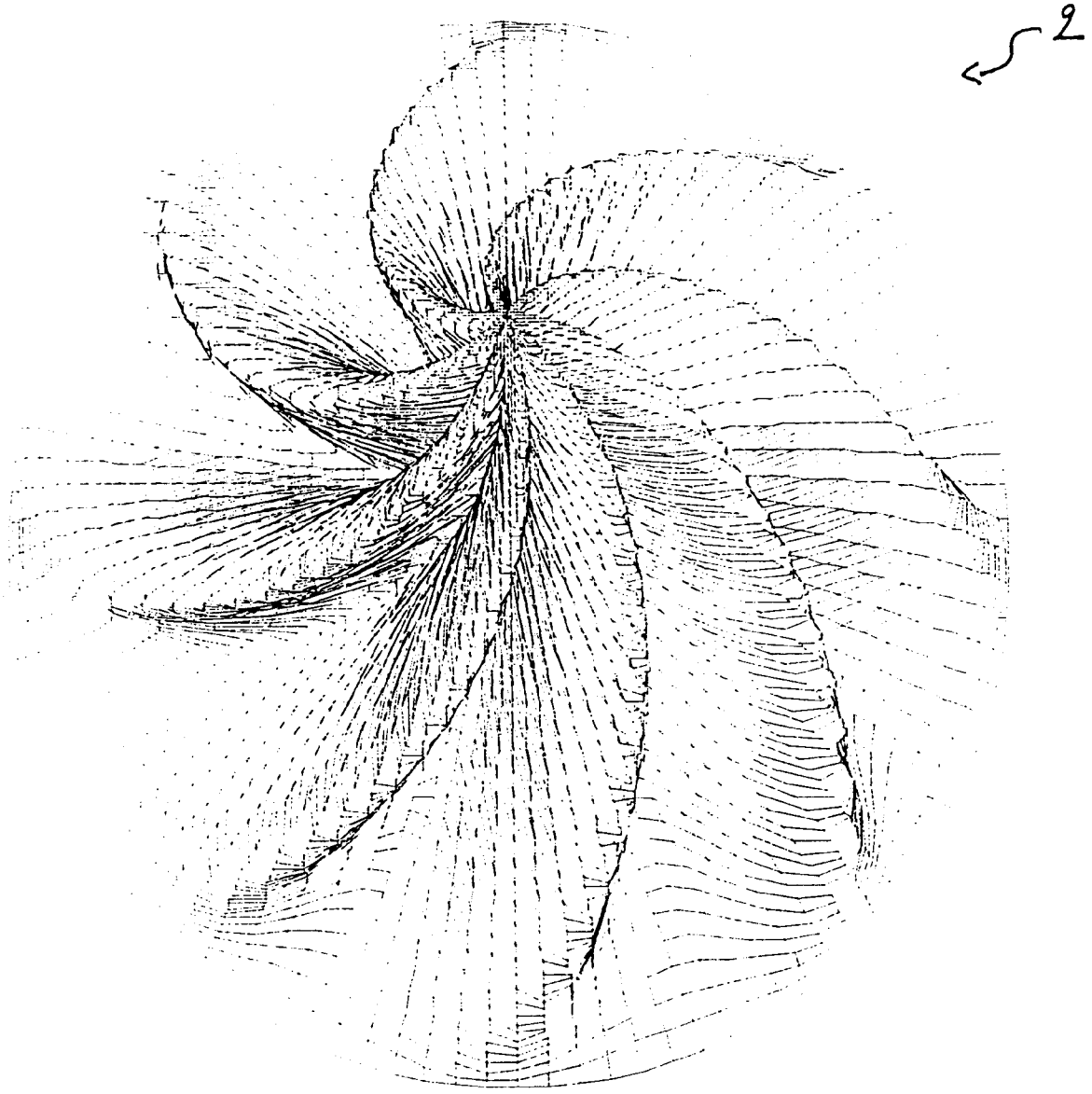
FIG. 10 is a view in perspective of the cavity according to the second embodiment of the invention.

A second embodiment is described with reference to FIGS. 8 to 10.

This second embodiment again has the essential features of the first embodiment. Only the shape of the cavity 2 varies. The geometry of the cavity 2 indeed favors the setting up of high convection currents in the beverage so that it is rapidly cooled.

According to this second embodiment, the internal cavity 2 advantageously is a double bottom of the can 10. It has, for example, a conical shape in vertical section (FIG. 8) and a star structure in horizontal section (FIG. 9). The cavity 2 is directly fixed to the bottom of the package 10, by bonding for example.

The connection means 5 associated with this second embodiment are similar to those described with reference to the first embodiment, as also are the associated delidding means.

When the cooling process is put into action, the package 10 is turned over (with bottom upwards). This specific feature can be indicated in the instructions of the self-cooling package according to the invention. The conical shape of the cavity 2 then concentrates the downward convection currents to the center of the can 10 and thus increases the beverage cooling speed.

The star-shaped structure of the cavity 2 furthermore increases its surface area of heat exchange with the beverage to be cooled. In this embodiment, the ratio of the volume to the surface area of the cavity 2 is then 3 to 5 times the corresponding ratio for the beverage package 10.

According to an alternative embodiment, the cavity 2 has a helical structure (FIG. 10) that prompts a rotational motion, known as a vortex, in the convection current. This contributes to the acceleration of this current. This particular structure can advantageously be obtained by a helical shaping of the star structure of FIG. 9. It can also be obtained, for example, by adding fins to the structure of the cavity 2.

It can be planned to make a helical structure of this kind fixedly joined to the lid of the package rather than to its bottom. In such a case, the can 10 will have to be kept upright during the cooling, and the means of connection 5 to the external pumping means must then be integrated into the lid.

According to one alternative embodiment, the conical structure 55 of the connection means 5 closing the cavity 2 penetrates into said cavity 2 so that the delidding punch zone is located towards the center of gravity of the cavity 2. It is thus possible to prevent a flow of the refrigerant liquid L through the connection means 5, when the cooling process is put into operation, whatever the position in which the package 10 is held.

The cooling of the beverage 15 contained in the can 10 is obtained by the evaporation of the liquid L contained in the internal cavity 2. This evaporation is caused and sustained by a depression in the internal cavity 2.

To this end, external pumping means are planned in association with the self-cooling package according to the invention, these external means being capable of activating and sustaining the reaction of evaporation of the refrigerant liquid L in the cavity 2.

Depending on the applications, these external pumping means can be constituted by a mechanical vacuum pump, or cryogenic pumping means such as cold traps which condense the water vapor, or again an evacuated cartridge containing reagents (desiccants) capable of activating the adsorption of the liquid L.

What is claimed is:

1. A self-cooling package for beverages, comprising:

an internal cavity;

a fitting for operatively connecting the cavity to an external pump, the cavity containing a coolant that evaporates under the effect of a depression that is sustained by the adsorption of the vapors of the coolant.

2. A self-cooling package for beverages according to claim 1, wherein the ratio of the volume to the surface area of the internal cavity is three to seven times smaller than the ratio of the volume to the surface area of the package.

3. A self-cooling package for beverages according to claim 1, wherein the internal cavity has a volume smaller than or equal to 2 cl for a package with a volume of 33 cl.

4. A self-cooling package for beverages according to claim 1, wherein the internal cavity has a contact surface greater than or equal to 50 $cm^2$ for a package with a volume of 33 cl.

5. A self-cooling package for beverages according to claim 1, wherein the internal cavity is sealed to the walls of the package.

6. A self-cooling package for beverages according to claim 1, wherein the coolant is water.

7. A self-cooling package for beverages according to claim 1, wherein the coolant is water containing an additive that lowers its temperature of solidification.

8. A self-cooling package for beverages according to claim 1, wherein the coolant partially fills the internal cavity.

9. A self-cooling package for beverages according to claim 1, wherein the partial pressure, in the internal cavity, of gases other than the vapor of the coolant, before connection to the external pump, is lower than or equal to 3 mb.

10. A self-cooling package for beverages according to claim 1, wherein the internal walls of the cavity are partially covered with a hydrophilic porous material.

11. A self-cooling package for beverages according to claim 1, wherein the fitting comprises a cone-like structure closing the internal cavity and comprising a delidding punch zone, the external pump being provided with a delidding device encased in said cone-like structure.

12. A self-cooling package for beverages according to claim 1, wherein the internal cavity has a geometry such that the coolant cannot flow through the fitting whatever the position in which the package is held.

13. A self-cooling package for beverages according to claim 1, wherein the cavity is a tubular structure made up of ribs mutually held together by plates and connected to the fitting.

14. A self-cooling package for beverages according to claim 13, wherein the cavity comprises a tube connecting the ribs to the fitting, said tube and the bottom of the package having crimped complementary conical shapes.

15. A self-cooling package for beverages according to claim 14, wherein the tube emerges at the center of the internal cavity, the ribs converging towards this central point.

16. A self-cooling package for beverages according to claim 1, wherein the internal cavity constitutes a double bottom of the package.

17. A self-cooling package for beverages according to claim 16, wherein the internal cavity has a conical shape with a star section.

18. A self-cooling package for beverages according to claim 16, wherein the internal cavity comprises a helical structure.

19. A self-cooling package for beverages according to claim 11, wherein the cone-like structure of the fitting enclosing the cavity penetrates the interior of said cavity so that the delidding punch zone is located towards the center of gravity of the cavity.

20. A self-cooling package for beverages according to claim 1, wherein the package is a steel can.

21. A self-cooling package for beverages according to claim 1, wherein the package is an aluminium can.

22. A self-cooling package for beverages according to claim 20, wherein the internal cavity is made of the same material as the package.

23. A self-cooling package for beverages according to claim 1, wherein the package is a bottle made of resistant plastic (PET plastic).

24. A self-cooling package for beverages, comprising a cooling means internal to said package and a connection means to a pumping means external to said package, the internal cooling means being formed by a cavity containing a refrigerant liquid that evaporates under the effect of a depression, and internal walls of the cavity being partially covered with a hydrophilic porous material.

25. A self-cooling package for beverages according to claim 24, wherein the ratio of the volume to the surface area of the internal cavity is three to seven times smaller than the ratio of the volume to the surface area of the package.

26. A self-cooling packaging system for beverages, comprising:

an internal cavity;

an external pump;

a fitting operatively connecting the internal cavity to said external pump, the internal cavity containing a coolant that evaporates under the effect of a depression that is sustained by the adsorption of the vapors of the coolant.

27. A self-cooling packaging system for beverages according to claim 26, wherein said fitting comprises a cone-like structure closing the internal cavity and comprising a delidding punch zone, and said external pump being provided with a delidding device encased in said cone-like structure.

* * * * *